US011291964B2

(12) United States Patent
Wessman

(10) Patent No.: US 11,291,964 B2
(45) Date of Patent: Apr. 5, 2022

(54) METHOD FOR MONITORING AND CONTROLLING MIXER OPERATION

(71) Applicant: Xylem Europe GmbH, Schaffhausen (CH)

(72) Inventor: Martin Wessman, Solna (SE)

(73) Assignee: Xylem Europe GmbH, Schaffhausen (CH)

( * ) Notice: Subject to any disclaimer, the term of this patent is extended or adjusted under 35 U.S.C. 154(b) by 120 days.

(21) Appl. No.: 16/957,435

(22) PCT Filed: Dec. 11, 2018

(86) PCT No.: PCT/EP2018/084265
§ 371 (c)(1),
(2) Date: Jun. 25, 2020

(87) PCT Pub. No.: WO2019/129483
PCT Pub. Date: Jul. 4, 2019

(65) Prior Publication Data

US 2021/0394139 A1 Dec. 23, 2021

(30) Foreign Application Priority Data

Dec. 27, 2017 (EP) ..... 17210688

(51) Int. Cl.
*B01F 15/00* (2006.01)
*B01F 7/00* (2006.01)

(52) U.S. Cl.
CPC .... *B01F 15/00201* (2013.01); *B01F 7/00341* (2013.01); *B01F 7/00733* (2013.01); *B01F 15/00922* (2013.01); *B01F 2215/0422* (2013.01)

(58) Field of Classification Search
CPC ..... B01F 15/00201; B01F 7/00341; B01F 7/00733; B01F 15/00922; B01F 2215/0422
(Continued)

(56) References Cited

U.S. PATENT DOCUMENTS 8,991,267 B1 * 3/2015 Kenney ..... G01L 3/10 73/862.338
10,941,377 B2 * 3/2021 Czwaluk ..... B01F 15/00285
(Continued)

FOREIGN PATENT DOCUMENTS

EP 3505236 A1 * 7/2019 ..... B01F 15/00201
WO 2016071447 A1 5/2016
WO 2016073499 A1 5/2016

OTHER PUBLICATIONS

International Search Report and Written Opinion for International Application No. PCT/EP2018/084265, dated Feb. 18, 2019, 10 pages.

*Primary Examiner* — Tony G Soohoo
(74) *Attorney, Agent, or Firm* — RatnerPrestia

(57) ABSTRACT

A mixer machine assembly having a drive unit with an electric motor, a drive shaft assembly connected to the electric motor, and a propeller. The propeller has a hub, a plurality of blades, and a propeller shaft from the drive shaft assembly. The control unit is operatively connected to the electric motor, and is configured for monitoring and controlling the operation of the mixer machine. The control unit monitors a drive shaft torque about a drive shaft of the drive shaft assembly. The control unit determines an average torque range based on at least one torque range, wherein each torque range is the difference between the highest and the lowest torque value detected during a predetermined angle of rotation of the propeller during operation of the mixer machine assembly. The control unit compares the
(Continued)

determined average torque range with a predetermined torque range limit value.

18 Claims, 2 Drawing Sheets

(58) Field of Classification Search
USPC ..... 366/601
See application file for complete search history.

(56) References Cited

U.S. PATENT DOCUMENTS

| | | | | |
|---|---|---|---|---|
| 2008/0200079 | A1* | 8/2008 | Jansen | B63H 16/14 440/1 |
| 2017/0341043 | A1 | 11/2017 | Atalla et al. | |
| 2018/0023046 | A1 | 1/2018 | Czwaluk | |
| 2020/0096997 | A1* | 3/2020 | Cella | G05B 19/4185 |

* cited by examiner

METHOD FOR MONITORING AND CONTROLLING MIXER OPERATION

CROSS-REFERENCE TO RELATED APPLICATIONS

This patent application is a U.S. National Phase Patent Application of PCT Application No.: PCT/EP2018/084265, filed Dec. 11, 2018, which claims priority to European Patent Application No. 17210688.2, filed Dec. 27 2017, each of which is incorporated by reference herein in its entirety.

TECHNICAL FIELD OF THE INVENTION

The present invention relates in general to the field of treatment plants suitable for biological treatment of liquid comprising solid matter, such as wastewater/sewage, and methods for monitoring and controlling such treatment plants. Further, the present invention relates specifically to the field of mixer machine assemblies suitable for operation in such treatment plants and methods for monitoring and controlling such mixer machine assemblies.

The present invention relates to a mixer machine assembly and to a method for monitoring drive shaft assembly load of a mixer machine of such a mixer machine assembly during operation, wherein the mixer machine assembly comprises, a drive unit that is part of the mixer machine, said drive unit comprising an electric motor and a drive shaft assembly connected to and driven in rotation by said electric motor during operation of the mixer machine assembly, a propeller that is part of the mixer machine, said propeller comprising a hub connected to a propeller shaft of the drive shaft assembly and a plurality of blades connected to said hub, wherein the propeller shaft extends in an axial direction (Z) and the blades extends in a radial direction, and a control unit that is operatively connected to the electric motor, the control unit being configured for monitoring and controlling the operation of the mixer machine.

BACKGROUND OF THE INVENTION

The mixer machine assembly is configured to be located in a tank or basin, such as a circulation channel, also known as a racetrack, or a non-circulation channel, e.g. circular or rectangular basins. The basin is for instance used during biological treatment or oxidation of a liquid, especially wastewater/sewage, or is used in digester or biogas applications. In biological treatment applications the wastewater is usually purified from nitrogen and biological material by having micro organisms breaking down the biological material into carbon dioxide and water, and by having bacteria transforming the water-bound nitrogen to aerial nitrogen. Purified wastewater is released back into the nature and in the case the water-bound nitrogen is not eliminated there is a risk for eutrophication in the natural watercourses, and due to the fact that the biological material is consuming considerable amounts of oxygen watercourses deficient in oxygen are generated if insufficiently purified water is released back into the nature. The breaking down of the biological material is stimulated by adding large amounts of oxygen to the wastewater by means of one or more aeration sectors, and the elimination of the water-bound nitrogen takes place in the circulation channel in areas without added oxygen or in separate basins without added oxygen and/or in areas/basins in which the dissolved oxygen level is low enough for the process to occur. This process is highly dependent on good and reliable mixing.

In biogas applications the waste, for instance manure from animals and compostable waste from households, is digested in order to produce biogas. This process is highly dependent on good and reliable mixing.

Flow generating machines/mixers machines are for instance used in wastewater basins in order to mix the liquid/wastewater in order to obtain an as homogenous liquid mixture as possible, in order to keep the biological material suspended in the liquid, as well as in order to generate a liquid flow that circulates/flows along the circulation channel as an endless stream.

In all applications the macro bulk flow in the basin is unstable and irregular over time. Some applications are more predictable than other, but no application is perfectly stable. Thus, the inflow to the propeller of the mixer machine is uneven over time and thereto uneven across the radial plane of the propeller. Uneven inflow causes uneven mechanical load on the propeller blades during operation, and elevated uneven mechanical load on the propeller blades causes uneven drive shaft assembly load and elevated risk of damage/fatigue of the drive shaft assembly, seals and bearings.

Therefore, typically all mixer machines are accompanied by installation guidelines, i.e. general minimum clearances between the propeller and the walls, bottom, obstacles, etc. However, every now and then these installation guidelines cannot be followed, and in such situations it is difficult or even impossible to predict if this will affect the propeller blade load, if the service interval needs to be adjusted, etc. Incorrect installation, i.e. incorrect location, of the mixer machine in relation to basin walls, floor, other mixer machines, etc., will increase the mechanical load on the propeller blades during operation.

Thus, during operation of the mixer machine assembly the propeller shaft of the drive shaft assembly, i.e. the forward end portion, will experience a bending force, i.e. a torque about a radial axis extending in a radial plane (XY), and it is known that said bending force and especially the short term variation of the bending force during each propeller revolution may lead to damages of the drive shaft assembly. The mixer machine operation restrictions and the expected service interval are based on history and the uncertainty is increased if the general installations guidelines are not followed. Even if the general installation guidelines are followed the varying nature of the liquid will also increase the uncertainty of the expected service interval and the operation limitations.

Thus, there is a need to be able to continuously monitor the operation of the mixer machine in order to more efficiently/accurately protect the mixer machine against unexpected breakdown.

Object of the Invention

The present invention aims at obviating the aforementioned disadvantages and failings of previously known methods for monitoring drive shaft assembly load of a mixer machine during operation, and at providing an improved method for monitoring drive shaft assembly load of a mixer machine during operation. A primary object of the present invention is to provide an improved method of the initially defined type which entails that precautionary measure may be taken based on the real-time conditions the mixer machine is subject to.

It is an object of the present invention to provide a method for monitoring drive shaft assembly load of a mixer machine during operation in order to be able to adjust the service interval based on the experienced load.

It is another object of the present invention to provide a method for monitoring drive shaft assembly load of a mixer machine during operation in order to evaluate whether the installation of the mixer machine needs to be changed.

It is another object of the present invention to provide a method for monitoring drive shaft assembly load of a mixer machine during operation in order to be able to decrease/limit the rotational speed of the mixer machine when needed, or even stop the mixer machine in extreme situations.

It is another object of the present invention to provide a method for monitoring drive shaft assembly load of a mixer machine, and in case of unexpected breakdown evaluate if the load was too high, or if the mixer machine may have too weak drive unit components when the load was determined not too high.

SUMMARY OF THE INVENTION

According to the invention at least the primary object is attained by means of the initially defined method and mixer machine assembly having the features defined in the independent claims. Preferred embodiments of the present invention are further defined in the dependent claims.

According to a first aspect of the present invention, there is provided a method of the initially defined type, which is characterized by the steps of: monitoring, by means of the control unit, a drive shaft torque (Tz) about a drive shaft of the drive shaft assembly, determining, by means of the control unit, an average drive shaft torque range (ATzR) based on at least one drive shaft torque range (TzR), wherein each drive shaft torque range (TzR) is equal to the difference between the highest drive shaft torque value ($Tz_{max}$) about the drive shaft and the lowest drive shaft torque value ($Tz_{min}$) about the drive shaft detected during a predetermined angle of rotation of the propeller during operation of the mixer machine assembly, and comparing, by means of the control unit, the determined average drive shaft torque range (ATzR) with a predetermined torque range limit value ($TzR_{limit}$).

According to a second aspect of the present invention, there is provided a mixer machine assembly of the initially defined type, which is characterized in that the control unit is configured to perform the inventive method.

Thus, the present invention is based on the insight that by means of monitoring and analyzing the short term variations of the drive shaft torque (Tz), i.e. the drive shaft torque range (TzR), this information can be used to take precautionary measures in order to protect the mixer machine from adverse load conditions and unexpected breakdown.

In a preferred embodiment of the present invention, the predetermined angle of rotation of the propeller is equal to or more than one blade pass, or equal to a multiple of blade passes. Thereto, it is also preferred that the predetermined angle of rotation of the propeller is equal to or less than three propeller revolutions. By having a smallest predetermined angle of rotation at least one full oscillation of the varying drive shaft torque is captured. By limiting the length of the predetermined angle of rotation, the long term variations have little or no effect on the monitoring of the short term variations of the drive shaft torque.

According to a preferred embodiment of the present invention, the plurality of drive shaft torque ranges (TzR) serving as basis for the determination of the average drive shaft torque range (ATzR) are equal to or more than 15 propeller revolutions. Thereto, it is also preferred that the plurality of drive shaft torque ranges (TzR) serving as a basis for the determination of the average drive shaft torque range (ATzR) are equal to or less than 90 propeller revolutions. By using several drive shaft torque ranges when determining the average, the effect of the long term variations of the drive shaft torque on the short term variation is also captured such that the influence on the monitoring from a single or a few drive shaft torque ranges being extraordinarily high is delimited.

According to a preferred embodiment of the present invention, the propeller of the mixer machine, during normal operation of the mixer machine assembly, has a rotational speed equal to or less than 400 rpm. Thus, the mixer machines concerned are so-called slowly rotating mixer machines, with or without mechanical gear transmission.

According to a preferred embodiment of the present invention, the control unit is integrated into the mixer machine. Thereby, the mixer machine comprises its own protective monitoring system.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF THE INVENTION

Figure 1:
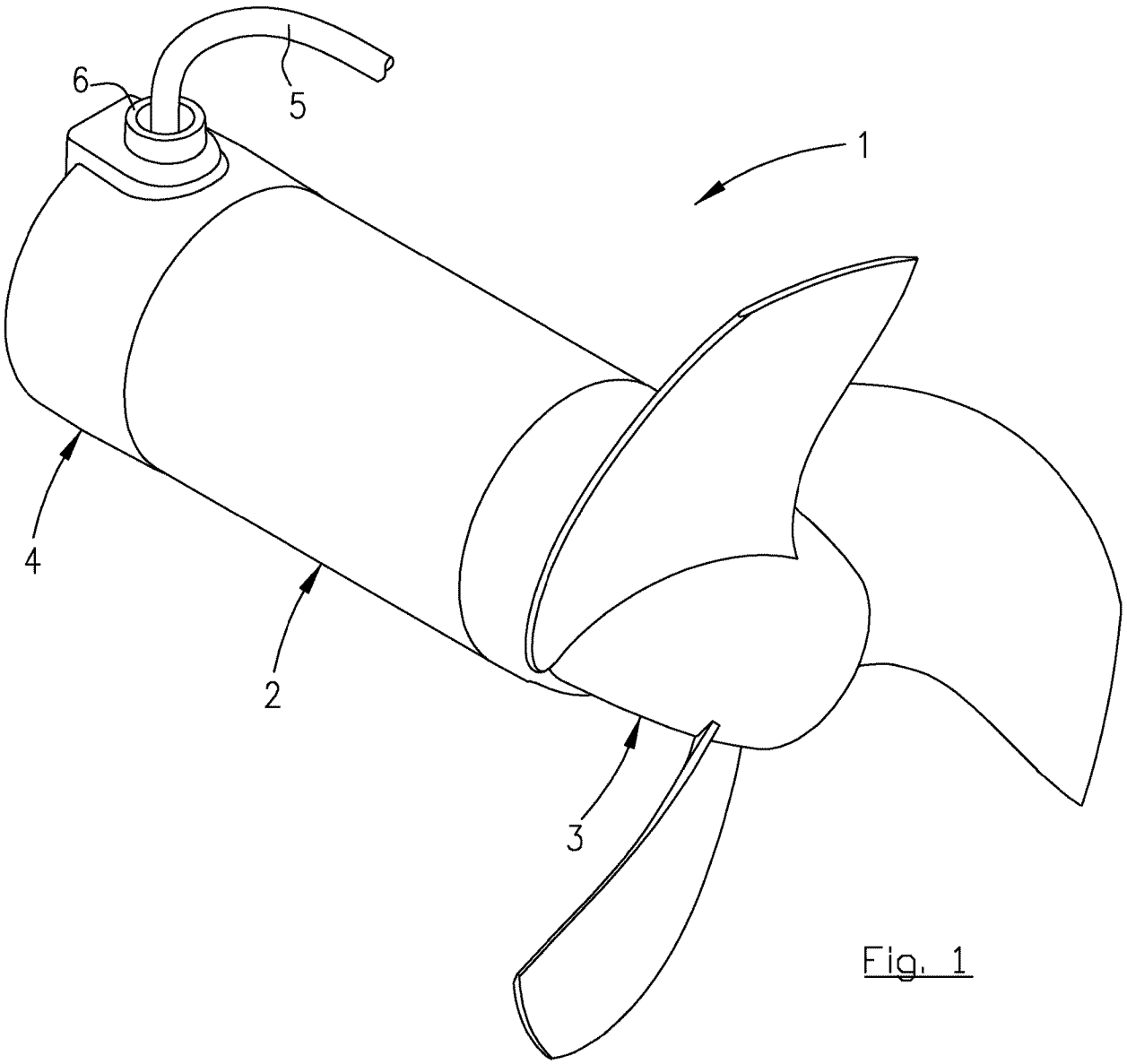
FIG. 1 is a schematic perspective view of an inventive mixer machine assembly.

Reference is initially made to FIG. 1. The present invention relates especially to a mixer machine assembly, generally designated 1, suitable for treatment/transportation of liquid comprising solid/biological matter, such as wastewater/sewage, and relates especially to a method for monitoring and controlling such a mixer machine assembly 1.

The inventive mixer machine assembly 1 is configured to be at least partly located in a basin/tank housing the liquid to be treated/transported. The basin can be constituted by a treatment basin at a treatment plant, such as a race track/circulation channel, the basin can be constituted by a digester tank at a biogas plant, etc.

The mixer machine assembly 1 comprises three major parts, a drive unit, generally designated 2, a propeller 3 and a control unit 4 (ECU). The control unit 4 controls the drive unit 2, the drive unit 2 drives the propeller 3 and the propeller 3 propels the liquid. The drive unit 2 and the propeller 3 are always parts of a mixer machine, and in the disclosed embodiment the control unit 4 is integrated into and constitutes a part of the mixer machine. In an alternative embodiment the control unit 4 is constituted by a separate member and is operatively connected to the mixer machine. The mixer machine is also called flow generating machine or mixer. In the disclosed embodiment the mixer machine is a submersible mixer machine, i.e. configured to be located entirely submerged. However, it shall be pointed out that a submersible mixer machine can be partly located above the liquid surface during operation.

An electric cable 5 extending from a power supply, for instance the power mains, provides power to the mixer machine assembly 1, the mixer machine assembly 1 comprising a liquid tight lead-through 6 receiving the electric cable 5. The electric cable 5 may also comprise signal wires for data communication between the mixer machine and an external control unit (not shown).

Figure 2:
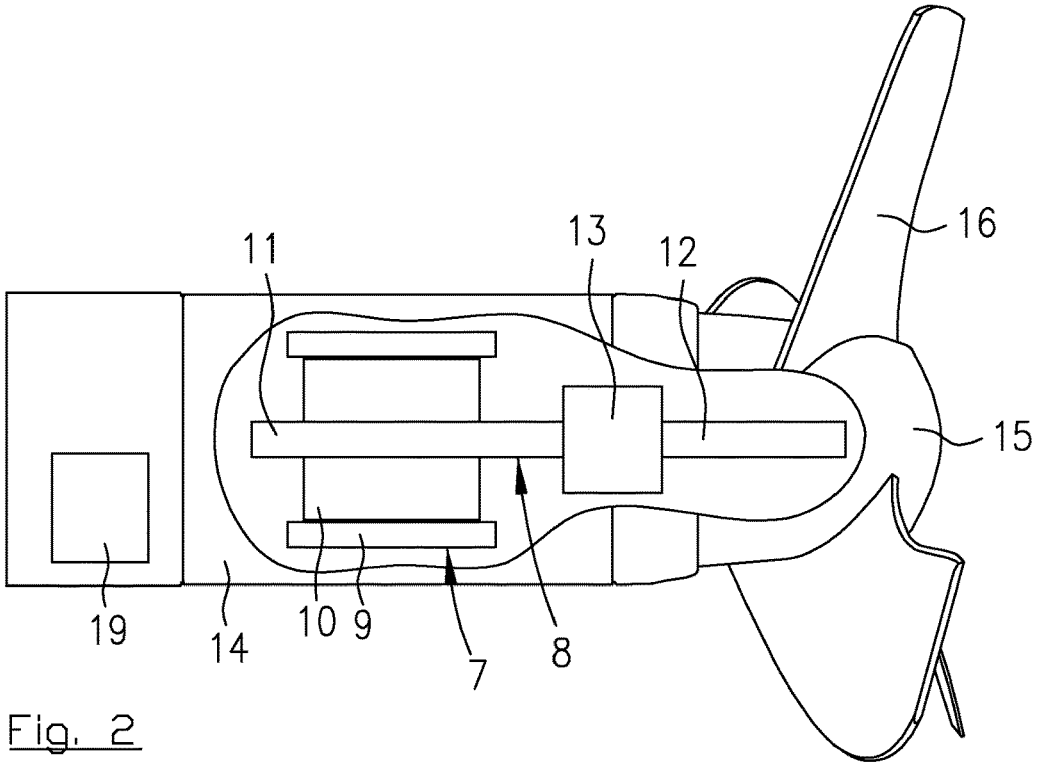
FIG. 2 is a semi-transparent schematic side view of the mixer machine assembly.

Reference is now also made to FIG. 2, wherein some internal parts of the mixer machine assembly 1 are schematically disclosed. The drive unit 4 comprises an electric motor, generally designated 7, and a drive shaft assembly 8 connected to and driven in rotation by said electric motor 7 during operation of the mixer machine assembly 1. The electric motor 7 comprises in a conventional way a stator 9 and a rotor 10. In the disclosed embodiment the drive shaft assembly 8 comprises a drive shaft 11, i.e. a rear end portion, and a propeller shaft 12, i.e. a forward end portion, wherein a mechanical transmission unit 13 is arranged between the drive shaft 11 and the propeller shaft 12. The rotor 10 is connected to and co-rotational with the drive shaft 11 of the drive shaft assembly 8. The propeller 3 is connected to and co-rotational with the propeller shaft 12 of the drive shaft assembly 8 in a conventional way. The transmission unit 13 has a fixed gear ratio wherein the propeller 3 has a lower rotational speed than the rotor 10 of the electric motor 7, i.e. reduced gearing. The gear ratio is preferably equal to or less than 100:1, more preferably equal to or less than 60:1, and preferably equal to or higher than 2:1, more preferably equal to or higher than 15:1. According to an alternative embodiment the gear ratio is 1:1, i.e. no gearing, the drive shaft 11 and the propeller shaft 12 being constituted by the same shaft member. The drive unit 2 also comprises necessary bearings and seals, which are particularly exposed to wear due to bending forces on the propeller shaft 12.

In the disclosed embodiment the drive shaft 11 and the propeller shaft 12 both extends in an axial direction, and are preferably collinear. According to an alternative embodiment the mechanical transmission unit 13 is angled, i.e. it is an angle between the drive shaft 11 and the propeller shaft 12, for instance 90 degrees. In the latter case, the propeller shaft 12 extends in the axial direction.

The rotational speed of the propeller 3 during normal operation of the mixer machine assembly 1 is equal to or less than 400 rpm, preferably equal to or less than 200 rpm, and equal to or higher than 10 rpm. This type of mixer machine assembly 1 is often called a slowly operated mixer machine assembly 1.

The electric motor 7 is located in a housing 14 and in the disclosed embodiment the propeller 3 is located in direct contact with the housing 14, the housing 14 being a liquid tight housing. However, in alternative embodiments the propeller 3 is located at a distance from the housing 14, i.e. the propeller shaft 12 of the drive shaft assembly 8 is visible between the housing 14 and propeller 3. According to the alternative embodiment the drive unit 4 is usually located in a dry environment. In most applications the mixer machine is a submersible mixer machine, i.e. both the drive unit 2 and the propeller 3 are located under the liquid surface during operation. In alternative embodiments the housing 14 and the electric motor 7 are not located in the liquid at the same time as the propeller 3 is located under the liquid surface, i.e. so-called top-entry or side-entry mixer machines.

The propeller 3 comprises a hub 15 connected to the propeller shaft 12 of the drive shaft assembly 8 and a plurality of blades 16 connected to said hub 15, wherein the propeller shaft 12 extends in an axial direction (Z) and each blade 16 extends in a radial direction seen from its base to its top, wherein the blade 16 is connected to the hub 15 at its base and wherein the top of the blade 16 is the outermost part of the propeller 3. In the disclosed embodiment both the leading edge 17 and the trailing edge 18 of the blade 16 are curved, the leading edge 17 is convex and the trailing edge 18 is concave. It shall be pointed out that the blades 16 naturally also have an extension in the axial direction, i.e. has a pitch, in order to generate thrust to the liquid. The control unit 4 is operatively connected to the electric motor 7, the control unit 4 being configured for monitoring and controlling the operation of the mixer machine. The electric motor 7 is configured to be driven in operation by the control unit 4. Thus, the control unit 4 is configured to control the rotational speed at which said electric motor 7 of the mixer machine is to be driven, for instance by controlling the frequency of the current operating the electric motor 7. According to the disclosed embodiment, the control unit 4 comprises a Variable Frequency Drive (VFD) 19.

It is essential for the present invention that the control unit 4 of the inventive mixer machine assembly 1 is configured to perform the inventive method, and that the method comprises the steps of: monitoring a drive shaft torque (Tz) about the drive shaft 11 of the drive shaft assembly 8, determining an average drive shaft torque range (ATzR) based on at least one drive shaft torque range (TzR), wherein each drive shaft torque range (TzR) is equal to the difference between the highest drive shaft torque value ($Tz_{max}$) about the drive shaft 11 and the lowest drive shaft torque value ($Tz_{min}$) about the drive shaft 11 detected during a predetermined angle of rotation of the propeller 3 during operation of the mixer machine assembly 1, and comparing the determined average drive shaft torque range (ATzR) with a predetermined torque range limit value ($TzR_{limit}$).

The torque range limit value ($TzR_{limit}$) is calculated/predetermined for each given propeller 3 and/or mixer machine.

The drive unit 4 is configured to determine/calculate the drive shaft torque (Tz) about the drive shaft 11 according to known procedures, for instance based on measuring of different electric signals available for the drive unit 4, such as current, electric voltage, output frequency of the VFD 19, rotational speed of the drive shaft 11, etc.

According to a preferred embodiment, the inventive method also comprises the step of performing precautionary measures when it is determined that the determined average drive shaft torque range (ATzR) exceeds the predetermined torque range limit value ($TzR_{limit}$). The precautionary measures are for instance sending alarm information to operator, saving alarm information in the control unit 4, decreasing the rotational speed of the propeller 3, etc. One precautionary measure performed by the operator based on alarm information from the control unit 4 is to balance the propeller, i.e. removing or adding weight to the top of one or more blades 16.

According to a preferred embodiment the determination of the average drive shaft torque range (ATzR) is based on a plurality of drive shaft torque ranges (TzR), and preferably the drive shaft torque ranged (TzR) of the plurality of drive shaft torque ranges (TzR) are in succession. According to an alternative embodiment, the plurality of drive shaft torque ranges (TzR) is constituted by every second drive shaft torque range (TzR).

Figure 3:
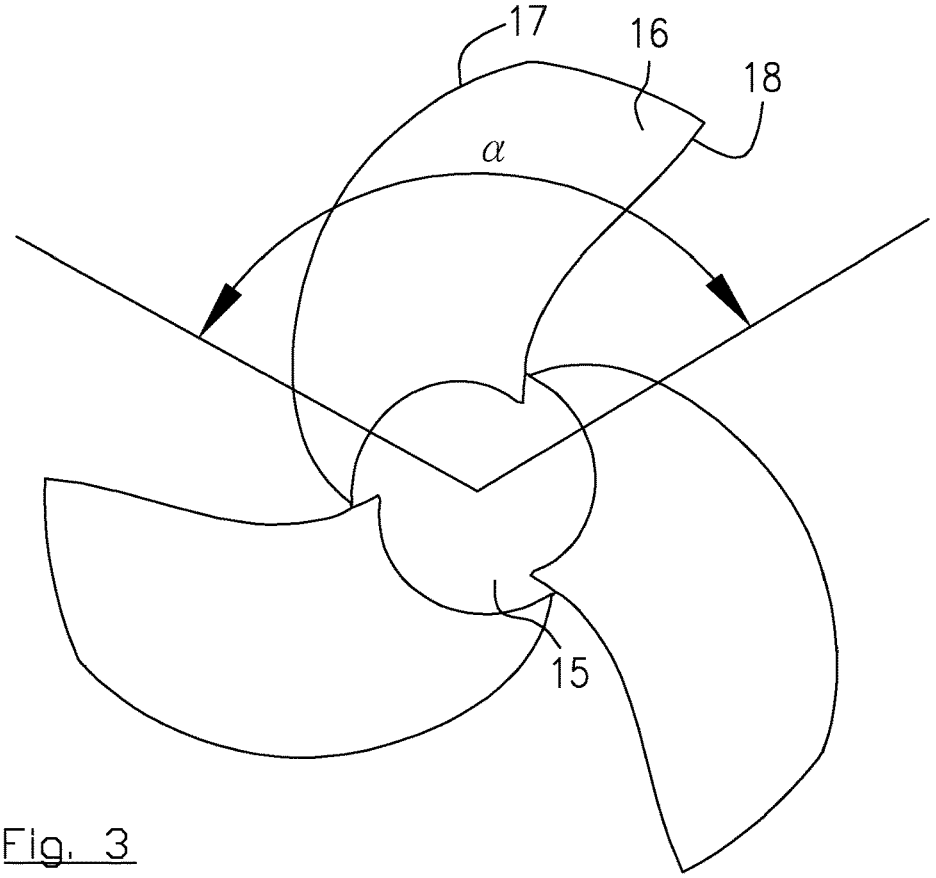
FIG. 3 is a schematic front view of the mixer machine assembly.

Reference is now also made to FIG. 3. The predetermined angle of rotation ($\alpha$) of the propeller 3 is equal throughout the operation of the mixer machine and is preferably equal to or more than one blade pass. It is also plausible that the predetermined angle of rotation of the propeller is equal to a multiple of blade passes. One blade pass is constituted by a predetermined portion of one propeller revolution, wherein said predetermined portion is equal to 360 angular degrees divided by the number of blades 16 of the propeller 3. Thus, in the disclosed embodiment one blade pass equals 120 angular degrees. The location of the interface between two adjoining blade passes, or between two adjoining predetermined angle of rotation, is of less importance. Preferably, the predetermined angle of rotation of the propeller 3 is equal to or less than three propeller revolutions, preferably equal to or less than one propeller revolution.

According to an alternative embodiment the average drive shaft torque range (ATzR) is a weighted average drive shaft torque range (WATzR), for instance based on the value of the highest drive shaft torque value ($Tz_{max}$) detected during each predetermined angle of rotation of the propeller 3, or based on the value of the lowest drive shaft torque value ($Tz_{min}$) detected during each predetermined angle of rotation of the propeller 3.

Preferably, the plurality of drive shaft torque ranges (TzR) serving as basis for the determination of the average drive shaft torque range (ATzR) are equal to or more than 15 propeller revolutions, preferably equal to or more than 30 propeller revolutions. Thereto, the plurality of drive shaft torque ranges (TzR) serving as a basis for the determination of the average drive shaft torque range (ATzR) are preferably equal to or less than 90 propeller revolutions, preferably equal to or less than 60 propeller revolutions.

The mixer machine assembly 1 comprises means adapted to execute the steps of the above method. Many of the steps of the above method are preferably performed/controlled by the control unit 4, and thus the term "the mixer machine assembly 1 comprises means . . . " does not necessarily imply that said means has to be located within the housing 14. Thus the term also includes means accessible/available/operatively connected to the mixer machine.

A computer program product/package comprising instructions to cause the mixer machine assembly 1 to execute the steps of the above method, is accessible/available/operatively connected to the mixer machine. Said computer program product is preferably located/run in the control unit 4.

There is a relationship between the average propeller shaft torque range (ATzR) about the propeller shaft 12 based on the torsional torque about the propeller shaft 12 and an average bending torque range (ATxyR) based on the bending torque about an axis in a radial plane, i.e. a plane perpendicular to the axial extension of the propeller shaft 12. Thus, the drive shaft torque (Tz) about the propeller shaft is a torsional torque and the radial torque (Txy) is a bending torque. ATxyR=k*ATzR, wherein k=5±2. The average bending torque range ATxyR is more critical than the average propeller shaft torque range ATzR, and it shall be pointed out that it is equivalent to use the bending torque range TxyR instead of the drive shaft torque range TzR in view of the inventive method.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall also be pointed out that even though it is not explicitly stated that features from a specific embodiment may be combined with features from another embodiment, the combination shall be considered obvious, if the combination is possible.

The invention claimed is:

1. A method for monitoring drive shaft assembly load of a mixer machine of a mixer machine assembly during operation, the mixer machine assembly comprising:

a drive unit comprising an electric motor, and a drive shaft assembly connected to and driven in rotation by the electric motor during operation of the mixer machine assembly;

a propeller comprising a hub, a propeller shaft of the drive shaft assembly connected to the hub, and extending in an axial direction (Z), and a plurality of blades connected to the hub and extending in a radial direction; and a control unit operatively connected to the electric motor and configured for monitoring and controlling the operation of the mixer machine;

the method comprising the steps of:

monitoring, by the control unit, a drive shaft torque (Tz) about the drive shaft of the drive shaft assembly;

determining, by the control unit, an average drive shaft torque range (ATzR) based on at least one drive shaft torque range (TzR), each drive shaft torque range (TzR) of the at least one drive shaft torque range (TzR) equaling a difference between a highest drive shaft torque value (Tzmax) about the drive shaft detected during a predetermined angle of rotation of the propeller during operation of the mixer machine assembly and a lowest drive shaft torque value (Tzmin) about the drive shaft detected during the predetermined angle of rotation of the propeller during operation of the mixer machine assembly, and comparing, by the control unit, the determined average drive shaft torque range (ATzR) with a predetermined torque range limit value (TzRlimit).

2. The method of claim 1, wherein the determination of the average drive shaft torque range (ATzR) is based on a plurality of drive shaft torque ranges (TzR).

3. The method of claim 2, wherein the plurality of drive shaft torque ranges (TzR) correspond to ranges measured during 15 or more propeller revolutions.

4. The method of claim 2, wherein the plurality of drive shaft torque ranges (TzR) correspond to ranges measured during 30 or more propeller revolutions.

5. The method of claim 2, wherein plurality of drive shaft torque ranges (TzR) correspond to ranges measured during 90 or fewer propeller revolutions.

6. The method of claim 2, wherein plurality of drive shaft torque ranges (TzR) corresponds to ranges measured during 60 or fewer propeller revolutions.

7. The method of claim 1, wherein the predetermined angle of rotation of the propeller is equal to or more than one blade pass.

8. The method of claim 7, wherein one blade pass comprises a predetermined portion of one propeller revolution, the predetermined portion equaling 360 angular degrees divided by a total number of blades of the propeller.

9. The method of claim 1, wherein the predetermined angle of rotation of the propeller is equal to or less than three propeller revolutions.

10. The method of claim 9, wherein the predetermined angle of rotation of the propeller is equal to or less than one propeller revolution.

11. The method of claim 1, wherein the average drive shaft torque range (ATzR) is a weighted average drive shaft torque range (WATzR) based on the value of the highest drive shaft torque value (Tzmax) detected during each predetermined angle of rotation of the propeller.

12. The method of claim 1, wherein the propeller of the mixer machine has a rotational speed equal to or less than 400 rpm during normal operation of the mixer machine assembly.

13. The method of claim 1, wherein the propeller of the mixer machine has a rotational speed equal to or less than 200 rpm during normal operation of the mixer machine assembly.

14. A mixer machine assembly comprising:

a mixer machine, the mixer machine comprising:

a drive unit comprising an electric motor, and a drive shaft assembly connected to and driven in rotation by the electric motor during operation of the mixer machine assembly;

a propeller comprising a hub, a propeller shaft of the drive shaft assembly connected to the hub and extending in an axial direction (Z), and a plurality of blades connected to the hub and extending in a radial direction; and a control unit operatively connected to the electric motor and configured for monitoring and controlling the operation of the mixer machine, the control unit including configured functions for:

monitoring a drive shaft torque (Tz) about a drive shaft of the drive shaft assembly;

determining an average drive shaft torque range (ATzR) based on one or more drive shaft torque ranges (TzR), each drive shaft torque range (TzR) equaling a difference between a highest drive shaft torque value (Tzmax) about the drive shaft and a lowest drive shaft torque value (Tzmin) about the drive shaft detected during a predetermined angle of rotation of the propeller during operation of the mixer machine assembly, and comparing the determined average drive shaft torque range (ATzR) with a predetermined torque range limit value (TzRlimit).

15. The mixer machine assembly of claim 14, wherein the control unit is integrated into the mixer machine.

16. The mixer machine assembly of claim 14, wherein the control unit comprises a variable frequency drive (VFD).

17. The mixer machine assembly of claim 14, wherein the mixer machine is a submersible mixer machine.

18. A computer program product comprising a non-transitory computer-readable medium storing a program including instructions that, when executed by a control unit of a mixer machine assembly of claim 14, causes the mixer machine assembly to:

monitor the drive shaft torque (Tz) about the drive shaft of the drive shaft assembly, determine the average drive shaft torque range (ATzR) based on the one or more drive shaft torque ranges (TzR); and compare the determined average drive shaft torque range (ATzR) with the predetermined torque range limit value (TzRlimit).

* * * * *